US007455244B2

(12) United States Patent
Boecking

(10) Patent No.: US 7,455,244 B2
(45) Date of Patent: Nov. 25, 2008

(54) FUEL INJECTOR WITH DIRECT-CONTROLLED INJECTION VALVE MEMBER

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 216 days.

(21) Appl. No.: 10/586,869

(22) PCT Filed: Dec. 2, 2004

(86) PCT No.: PCT/EP2004/053230

§ 371 (c)(1),
(2), (4) Date: Jul. 21, 2006

(87) PCT Pub. No.: WO2005/075811

PCT Pub. Date: Aug. 18, 2005

(65) Prior Publication Data

US 2007/0152084 A1 Jul. 5, 2007

(30) Foreign Application Priority Data

Feb. 4, 2004 (DE) ..... 10 2004 005 456

(51) Int. Cl.
*B05B 1/08* (2006.01)

(52) U.S. Cl. ..... 239/102.2; 239/584

(58) Field of Classification Search ..... 239/88, 239/90, 91, 102.2, 584, 585.1, 585.4, 585.5
See application file for complete search history.

(56) References Cited

U.S. PATENT DOCUMENTS

| | | | | |
|---|---|---|---|---|
| 5,697,554 | A * | 12/1997 | Auwaerter et al. | 239/88 |
| 6,651,950 | B2 * | 11/2003 | Stoecklein et al. | 251/57 |
| 2003/0127617 | A1 | 7/2003 | Kegel | |

FOREIGN PATENT DOCUMENTS

| | | | |
|---|---|---|---|
| DE | 195 19 191 | A1 | 12/1996 |
| DE | 101 45 620 | A1 | 4/2003 |
| DE | 102 25 686 | A1 | 1/2004 |
| WO | WO 96/37698 | A1 | 11/1996 |
| WO | WO 2005/010343 | A1 | 2/2005 |

* cited by examiner

*Primary Examiner*—Christopher S Kim
(74) *Attorney, Agent, or Firm*—Ronald E. Greigg

(57) ABSTRACT

A fuel injector for injecting fuel into a combustion chamber of an internal combustion engine, the injector having body and a nozzle holder in which an injection valve member is movably received, which injection valve member has a seat that opens or closes injection openings, and the injection valve member is actuatable via a piezoelectric actuator. The piezoelectric actuator actuates a first booster piston, in which a second booster piston, connected to the injection valve member is guided.

9 Claims, 1 Drawing Sheet

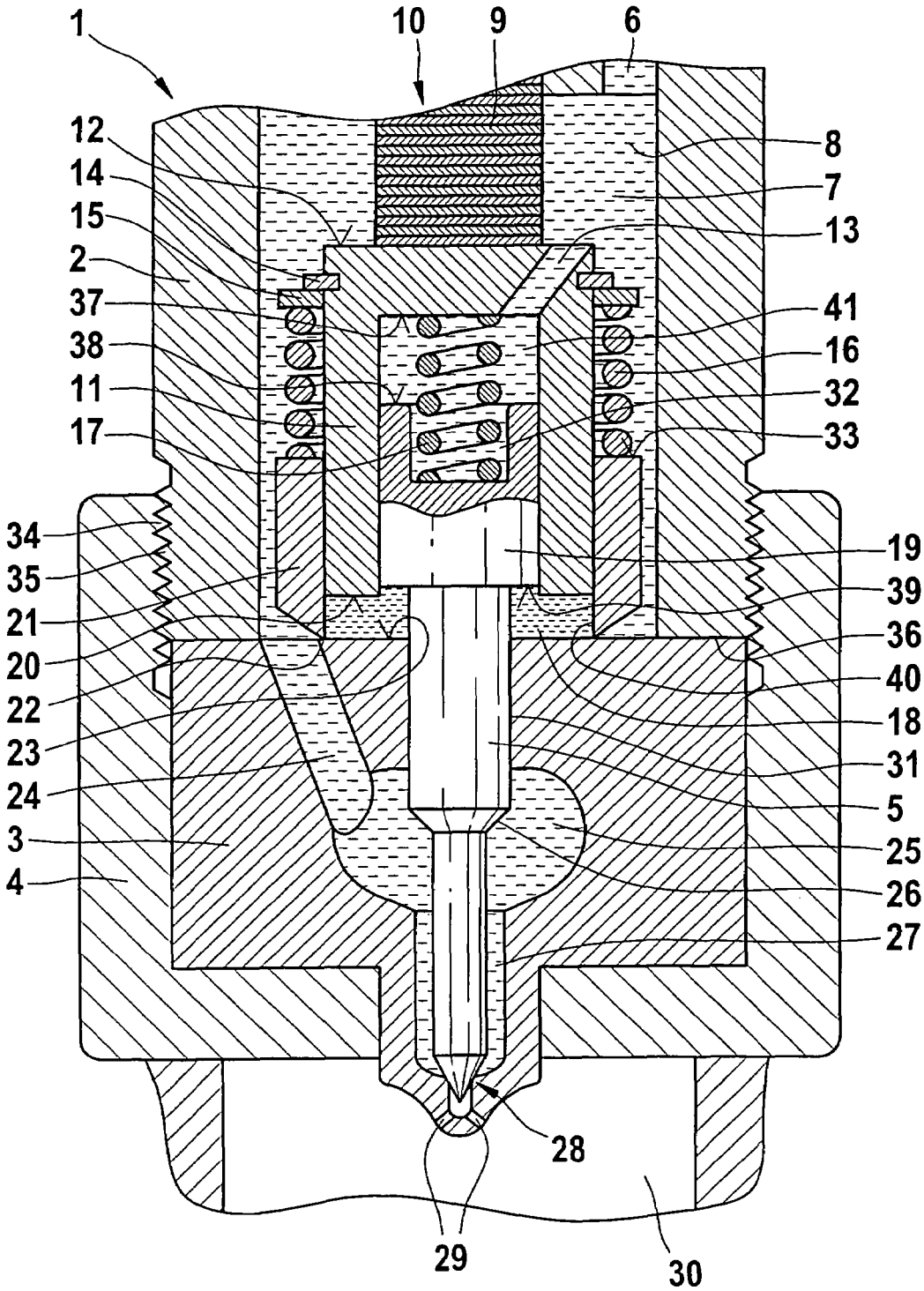
1
10
9
6
12
14
15
2
37
38
11
17
8
7
13
41
16
32
33
34
35
21
20
22
23
24
3
4
19
39
36
40
18
31
5
25
26
27
28
29
30

FUEL INJECTOR WITH DIRECT-CONTROLLED INJECTION VALVE MEMBER

CROSS-REFERENCE TO RELATED APPLICATIONS

This application is a 35 USC 371 application of PCT/EP 2004/053230 filed on Dec. 2, 2004.

BACKGROUND OF THE INVENTION

1. Field of the Invention

In internal combustion engines, reservoir injection systems (common rail systems) are increasingly used today; they make it possible to adjust the injection pressure independently of rpm and load. In common rail systems, the pressure generation and the injection event are decoupled from one another both chronologically and in terms of location. The injection pressure is generated by a separate high-pressure pump. This pump need not necessarily be driven synchronously with the injections. The pressure can be adjusted independently of the engine rpm and the injection quantity. In common rail systems, instead of pressure-controlled injection valves, electrically actuated injectors are used, with which the triggering instant and duration of triggering, the injection onset, and the injection quantity can be determined. In this type of injection system, there is great freedom with regard to the design of multiple injections or subdivided injections.

2. Prior Art

Fuel injectors for reservoir injection systems are as a rule triggered via solenoid valves or piezoelectric actuators. By means of the solenoid valves or piezoelectric actuators, a pressure relief of a control chamber is effected. To that end, the control chamber has a relief conduit, in which as a rule there is an outlet throttle. Filling the control chamber for actuating the injection valve member is as a rule done via an inlet from valve associated with the control chamber, or the piezoelectric actuator associated with it, a valve closing member is actuated, which closes the outflow conduit. Upon actuation of the solenoid valve or piezoelectric actuator, the valve closing member, which may for example be a ball body or a cone, uncovers the outflow conduit, so that a control volume is capable of flowing out of the control chamber. As a result, the pressure in the control chamber drops, and an injection valve member, as a rule embodied as a needle, acted upon by the control chamber moves vertically upward. As a result of the upward motion of the injection valve member, injection openings on the end of the fuel injector toward the combustion chamber are uncovered, so that fuel can be injected into the combustion chamber of an internal combustion engine.

The fuel injectors known from the prior art, which are actuatable via solenoid valves or piezoelectric actuators, as a rule include an injector body, which is constructed in pressureproof and pressuretight fashion. The solenoid valve or piezoelectric actuator is received outside this injector body. As a result, the pressure level in the control chamber is lowered via the opening of the outflow conduit. On this principle, an actuation of the needle-like injection valve member is effected indirectly. A hydraulic booster device is as a rule associated with the piezoelectric actuator that is located outside the valve body, so that the stroke travel of the piezoelectric actuator can be lengthened, since the piezoelectric crystals, in stacked form, when supplied with current have only a slight change in length. If conversely the fuel injector is actuated via a solenoid valve, then it is necessary that its remnant air gap and armature stroke travel be adjusted exactly, in order to trigger the valve closing member, which closes the outflow conduit of the control chamber, suitably precisely, particularly in the high rpm range of an internal combustion engine.

Because of the trigger devices, that is, a solenoid valve or piezoelectric actuator, that are located outside the injector body, the fuel injectors known from the prior art are relatively tall and accordingly require greater installation space in the region of the cylinder head of an engine. The trend in modem engines, however, is to increasingly less available installation space in the region of the cylinder head. This is associated with the fact that internal combustion engines with high specific power per liter of displacement require more-complicated cooling of the cylinder head region. This is done as a rule through conduits that penetrate the cylinder head of the engine and that both for thermal reasons and for reasons of thermal conductivity have a certain course. As a result, the installation space required for installing fuel injectors is reduced, and there is accordingly a need for developing other solutions to the problem.

SUMMARY AND ADVANTAGES OF THE INVENTION

By the solution proposed according to the invention, a fuel injector of especially compact structure is furnished, with which a direct actuation of a needle-like injection valve member is achieved. To that end, an actuator that has a piezoelectric crystal stack is received in a pressure chamber that is filled with fuel at system pressure. A face end communicates with a first booster piston, which surrounds a second booster piston. The second booster piston is embodied on the injection valve member. The first booster piston and the second booster piston are guided one inside the other, which makes further guidance of the injection valve member, besides a guide portion thereof, possible inside the nozzle holder. As a result, a further guide portion of the injection valve member can be dispensed with.

The first booster piston is surrounded by a control chamber sleeve, which is positioned against a plane face of the nozzle holder by the action of a compression spring. The bite edge of the control chamber sleeve is kept by the compression spring constantly in contact with the plane face of the nozzle holder combination, thereby assuring the sealing off of the control chamber.

From the control chamber that is at system pressure, the fuel flows via a nozzle chamber inlet to the nozzle chamber surrounding the injection valve member and from there via an annular gap to the seat of the injection valve member. As a result of the solution proposed by the invention, the current supply time of the piezoelectric actuator can be shortened, since the piezoelectric actuator keeps the injection valve member in its closing position not in the state in which it is supplied with current but rather in the currentless state. If current is supplied to the actuator, a pressure increase in the control chamber takes place, as a result of which the second booster piston connected to the injection valve member is opened. The injection valve member thereupon uncovers the injection openings toward the combustion chamber. Conversely, if current is not being supplied to the actuator, the injection valve member is pressed into its closing position by a compression spring located in a hydraulic chamber between the first booster piston and the second booster piston. The proposed pressure booster for a fuel injector therefore acts as a pressure booster with a reversal of its direction, which brings about opening of the injection valve member when current is supplied to the actuator and closes the injection valve member in the currentless state.

BRIEF DESCRIPTION OF THE DRAWINGS

The invention is described in further detail below, in conjunction with the single drawing FIGURE showing a section through the fuel injector proposed according to the invention, with direct control of the injector valve member.

DESCRIPTION OF THE PREFERRED EMBODIMENTS

The drawing shows a fuel injector 1, which includes an injector body 2 connected to a nozzle holder 3 via a nozzle lock nut 4. This arrangement is also known as a nozzle holder combination. For connecting the injector body 2 and the nozzle holder 3, a male-threaded portion 34 is provided on the injector body, onto which the nozzle lock nut 4, provided with a female thread 35, is tightened at a predetermined torque. The nozzle lock nut 4 surrounds the nozzle holder 3 with an annular contact face.

In the injector body 2, a high-pressure inlet 6 is provided, which communicates with a high-pressure storage volume (common rail), not shown in the drawing. The high-pressure storage volume is acted upon via a high-pressure pump, not shown in the drawing. The pressure level (system pressure) that prevails in the common rail is in the range between 1400 bar and 1600 bar. Via the high-pressure inlet 6, a pressure chamber 7, which is embodied in the injector body 2, is subjected to fuel 8, which is at system pressure. From the pressure chamber 7 inside the injector body 2, a nozzle chamber inlet 24 branches off, by way of which the fuel that is at system pressure is delivered to a nozzle chamber 25 in the nozzle holder 3.

Inside the pressure chamber 7, which serves as a hydraulic additional volume with which pressure fluctuations can be damped or done away with entirely, an actuator 9 is received, which is preferably embodied as a piezoelectric actuator and has a piezoelectric crystal stack 10. When current is supplied to the piezoelectric crystal stack 10 via contacts, not shown in the drawing, the piezoelectric crystals, in stack form, experience a change in length, which can be utilized to actuate the injection valve member.

The piezoelectric actuator 9 rests on a face end 12 of a first booster piston 11. The wall of the first booster piston 11 is provided with a compensation bore 13, by way of which the pressure chamber 7 is in communication with a hydraulic chamber 41. The first booster piston 11 surrounds a second booster piston 19 that is received on the injection valve member 5. The second booster piston 19 furthermore has a recess 32, with a spring element 17 let into it that is braced at a contact face 37 in the inside of the first booster piston 11. The second booster piston 19 and the injection valve member 5 are solidly connected to one another. A first annular face 38 of the second booster piston 19 defines the hydraulic chamber 41, while a second annular face 39 on the underside of the second booster piston 19 defines a control chamber 18. The control chamber is likewise defined by an annular face 20 on the underside of the first booster piston 11, as well as by the inside 40 of a control chamber sleeve 21 and an annular plane face portion 23 of the nozzle holder 3 that rests on the injector body 2.

A support ring 14 is received on the jacket face of the first booster piston 11, and a contact ring 15 is braced on the support ring. The contact ring 15 forms a contact face for a compression spring 16, which presses the control chamber sleeve 21 against the plane face 23 of the nozzle holder 3. The control chamber sleeve 21 surrounding the first booster piston 11 has a bite edge 22. By the action of pressure on the control chamber sleeve 21 by means of the compression spring 16, the bite edge 22 is pressed sealingly against the top of the plane face 23 of the nozzle holder 3. Thus the control chamber 18, in which for actuating the injection valve member 5 of pressure other than the system pressure inside the pressure chamber 5 is necessary, is effectively sealed off from the pressure chamber 7 that is acted upon by fuel 8 that is at system pressure.

The injection valve member 5 is received in the nozzle holder 3 inside a guide portion 31. Located below the guide portion 31 is the nozzle chamber 25, which is acted upon by fuel 8 that is at system pressure from the pressure chamber 7 through the nozzle chamber inlet 24 already mentioned. From the nozzle chamber 25, the annular gap 27 extends to the seat 28 of the injection valve member 5 on the end toward the combustion chamber of the nozzle holder 3. If the injection valve member 5 is placed in the seat 28, the injection openings 29 into the combustion chamber of the engine are closed; conversely, if the seat 28 is opened, then fuel can be injected into the combustion chamber of the engine via the nozzle chamber inlet 24, the nozzle chamber 25, the annular gap 27, and the then-opened injection openings 29.

To assure the subjection of the control chamber sleeve 21 to pressure, this sleeve, on the side toward the compression spring 16, has a contact face 33 for the compression spring 16. The face end of the injector body 2 and the plane face 23 of the nozzle holder 3 form an abutting seam 36, which surrounded by the nozzle lock nut 4 when the injector body 2 and nozzle holder 3 are screwed together represents a pressuretight seal of the control chamber 18.

The mode of operation of the fuel injector shown in the drawing is described below:

In the currentless state of the piezoelectric crystal stack 10 of the actuator 9, the first booster piston 11 remains in its position of repose, because of the pressure equilibrium between the pressure chamber 7 and the hydraulic chamber 41 via the inflow bore 13. The spring element 17 resting on the contact face 37 urges the second booster piston 19 in the closing direction, so that the injection valve member 5, solidly joined to this booster piston, is put into its seat 28. As a result, the injection openings 29 embodied on the end of the nozzle holder 3 toward the combustion chamber are closed. No fuel reaches the combustion chamber 30 of the engine. The spring element 17 is designed such that in the closing state it generates a higher closing force, which exceeds the hydraulic force acting in the opening direction that is generated at the pressure step 26 in the pressure chamber 25 when pressure is exerted on that.

If conversely current is supplied to the piezoelectric crystal stack 10 of the actuator 9, then the individual piezoelectric crystals of the piezoelectric crystal stack 10 lengthen, so that a force on the face end 12 of the first booster piston 11 is generated which moves this booster piston downward in the vertical direction. The annular face 20 of the first booster piston 11 that moves into the control chamber 18 in the process causes a pressure increase in the control chamber. This pressure increase is transmitted to the second annular face 39 on the underside of the second booster piston 19. Both the hydraulic force engaging the second annular face 39 of the second booster piston 19 and the hydraulic force engaging the pressure step 26 in the nozzle chamber 25 exceed the closing force generated by the spring element 17, and accordingly the injection valve member 5 moves with the second booster piston 19 into the hydraulic chamber 41. The fuel volume positively displaced from the hydraulic chamber in the process flows into the pressure chamber 7 via the bore 13.

The injection valve member 5 as it opens moves out of its seat 28 embodied on the end toward the combustion chamber of the nozzle holder 3, so that the injection openings 29 are uncovered and the fuel at system pressure from the nozzle chamber 25, which flows to the injection openings 29 via the annular gap 27, can be injected into the combustion chamber 30.

Conversely, if the current supply to the piezoelectric crystal stack 10 of the actuator 9 is withdrawn, the first booster piston 11 moves into its position of repose, and as a result the pressure prevailing in the control chamber 18 decreases. Because of the pressure decrease in the control chamber 18, the hydraulic force acting in the opening direction and engaging the second annular face 39 on the underside of the second booster piston 19 drops, so that the closing motion is effected by the spring element 17 received in the hydraulic chamber 41, while the force acting in the closing direction exceeds the hydraulic force engaging the pressure step 26. As a result, the injection valve member 5, solidly joined to the second booster piston 19, is put into its seat 28 toward the combustion chamber. The injection openings 29 are accordingly closed, and fuel can no longer be injected into the combustion chamber 30 of the engine.

The first booster piston 11 and the second booster piston 19 represent a pressure boost with a reversal of direction. In it, the injection valve member is opened when current is supplied to the actuator, while the injection valve member is moved into its closing position when the actuator is currentless. The booster pistons 11 and 19 guided one inside the other form a further guide of the injection valve member, and this member need not be embodied in a housing. The injection valve member 5 can advantageously be guided movably only inside a guide portion 31 in the nozzle holder 3.

Since the actuator 9 is located inside the pressure chamber 7 that is subjected to system pressure, the proposed fuel injector is very compact in structure. The disposition of the booster pistons 11 and 19 as well as of the control chamber sleeve 21 received on the jacket face of the first booster piston 11 makes it advantageously possible to compensate easily for bearing tolerances of the injector body 2 as well as of the control chamber sleeve 21 relative to the plane face 23 of the nozzle holder 3. A further advantage of the embodiment of the fuel injector 1 proposed according to the invention is seen in the fact that the current supply time of the actuator 9 can be shortened, which has a favorable effect on its service life.

The foregoing relates to a preferred exemplary embodiment of the invention, it being understood that other variants and embodiments thereof are possible within the spirit and scope of the invention, the latter being defined by the appended claims.

The invention claimed is:

1. A fuel injector for injecting fuel into a combustion chamber of an internal combustion engine, the injector comprising, an injector body, a nozzle holder, an injection valve member movably received in the nozzle holder, the injection valve member having a seat that opens or closes injection openings, a piezoelectric actuator, a first booster piston directly actuated by the piezoelectric actuator, and a second booster piston guided in the first booster piston and connected to the injection valve member for varying pressure inside a control chamber, wherein the piezoelectric actuator is received inside a pressure chamber, embodied in the injector body, which chamber has an inlet for fuel at system pressure and wherein the control chamber is defined by a control chamber sleeve, an annular face of the first booster piston, an annular face of the second booster piston, and a plane face of the nozzle holder.

2. The fuel injector as recited in claim 1, the control chamber sleeve is guided on the first booster piston and is acted upon via a compression spring.

3. The fuel injector as recited in claim 1, wherein the control chamber is sealed off from the pressure chamber via a bite edge that cooperates with the plane face of the nozzle holder.

4. The fuel injector as recited in claim 2, wherein the control chamber is sealed off from the pressure chamber via a bite edge that cooperates with the plane face of the nozzle holder.

5. The fuel injector as recited in claim 1, further comprising a hydraulic chamber between the first booster piston and the second booster piston, which hydraulic chamber communicates hydraulically, via a compensation bore, with the pressure chamber inside the injector body.

6. The fuel injector as recited in claim 5, further comprising a spring element resting against a contact face and received inside the hydraulic chamber, the spring element urging the injection valve member in the closing direction.

7. The fuel injector as recited in claim 1, further comprising a nozzle chamber in the nozzle holder surrounding the injection valve member, a nozzle chamber inlet branching off from the pressure chamber and connecting the pressure chamber with the nozzle chamber.

8. The fuel injector as recited in claim 1, wherein the the injection valve member is guided inside the nozzle holder by a guide portion and inside the injector body by the booster pistons.

9. The fuel injector as recited in claim 6, wherein the hydraulic chamber, which communicates with the pressure chamber via a compensation bore, comprises a contact face for the spring element, which contact face is braced in a recess of the second booster piston, which piston has a first annular face that defines the hydraulic chamber.

* * * * *